United States Patent [19]

Wakita et al.

[11] Patent Number: 4,874,577

[45] Date of Patent: Oct. 17, 1989

[54] WEAR-RESISTANT INTERMETALLIC COMPOUND ALLOY HAVING IMPROVED MACHINEABILITY

[75] Inventors: Saburo Wakita; Junji Hoshi, both of Omiya, Japan

[73] Assignee: Mitsubishi Kinzoku Kabushiki Kaisha, Tokyo, Japan

[21] Appl. No.: 120,177

[22] Filed: Nov. 9, 1987

Related U.S. Application Data

[63] Continuation-in-part of Ser. No. 938,005, Dec. 4, 1986, abandoned.

[30] Foreign Application Priority Data

| | | | |
|---|---|---|---|
| Dec. 23, 1985 | [JP] | Japan | 60-289600 |
| Feb. 12, 1986 | [JP] | Japan | 61-28508 |
| Feb. 12, 1986 | [JP] | Japan | 61-28509 |
| Feb. 12, 1986 | [JP] | Japan | 61-28510 |

[51] Int. Cl.[4] ..... C22C 14/00; C22C 19/03; C22C 19/07; C22C 30/00

[52] U.S. Cl. ..... 420/417; 420/421; 420/435; 420/439; 420/440; 420/441; 420/451; 420/452; 420/453; 420/454; 420/457; 420/458; 420/459; 420/581; 420/582; 420/586; 420/587; 420/588; 420/589

[58] Field of Search ..... 420/417, 421, 435, 439, 420/440, 441, 451, 452, 453, 454, 457, 458, 459, 581, 582, 583, 584, 585, 586, 587, 588, 589

[56] References Cited

U.S. PATENT DOCUMENTS

| | | | |
|---|---|---|---|
| 3,276,865 | 10/1966 | Freche et al. | 420/439 |
| 3,660,082 | 5/1972 | Negishi et al. | 420/451 |
| 4,011,075 | 3/1977 | Watanabe et al. | 420/421 |
| 4,019,899 | 4/1977 | Negishi et al. | 420/580 |

FOREIGN PATENT DOCUMENTS

| | | | |
|---|---|---|---|
| 157934 | 9/1983 | Japan | 420/580 |
| 28548 | 2/1984 | Japan | 420/451 |

*Primary Examiner*—Robert McDowell
*Attorney, Agent, or Firm*—Frishauf, Holtz, Goodman & Woodward

[57] ABSTRACT

Disclosed is a wear-resistant intermetallic compound alloy having superior machineability which consists essentially of: 45–60% of either Ni or Co or both with cobalt content of at least 5%, at least one of 0.1–2% of Hf and 0.05–2% of Re, 0–2% of at least one element selected from the group consisting of Si, P, Cu, Zn, Ga, Ge, Cd, In, Sn, Sb, Pb and Bi, 0–2% of C, and 0–5% of at least one element selected from the group consisting of Zr, Fe, V, Nb, Ta, Cr, Mo, W and Mn, the balance being Ti and incidental impurities, the percent being atomic percent.

14 Claims, No Drawings

WEAR-RESISTANT INTERMETALLIC COMPOUND ALLOY HAVING IMPROVED MACHINEABILITY

This application is a continuation-in-part of application Ser. No. 938,005, filed Dec. 4, 1986, now abandoned.

FIELD OF ART

The present invention relates to an intermetallic compound alloy that has superior machineability and wear resistance and which is suitable for use in the manufacture of molds for the shaping of depolarizing mixes for dry cells, dies for drawing optical fibers, etc., and other wear-resistant parts such as valves and pump components.

BACKGROUND ART

Conventionally, parts that are used in applications where high wear resistance is required are made of intermetallic compound alloys that contain 45–60 atomic percent (all percentages mentioned hereinafter are on an atom basis) of Ni or Co or both, with the balance being composed of Ti and incidental impurities. Such intermetallic compound alloys exhibit high wear resistance for a prolonged period of time but, on the other hand, their machineability is poor and it is difficult to drill them. So much skill and time is necessary to machine these alloys into complicated shapes that the production cost of the finished product becomes substantial.

In addition, because of their high Ti content, the intermetallic compounds described above will easily absorb oxygen; the increase in the oxygen in the alloy causes its rapid embrittlement and the chance of the occurrence of cracking in the alloy during machining is increased. To avoid this problem, the alloy must be melted and cast either in vacuum or in an atmosphere in which the air has been fully displaced with an inert gas. Furthermore, the starting material to be melted desirably has a minimum oxygen content. In fact, however, some of the commercial titanium feeds contain at least 500–1,500 ppm of oxygen and, if such $O_2$-rich titanium feeds are used, the oxygen content of the resulting alloy will become as high a 1,200–2,000 ppm of oxygen even if the melting and casting operations are performed in vacuum or in an inert atmosphere. An alloy having such high oxygen content has no use other than as scrap because its toughness is too low to withstand machining.

SUMMARY OF THE INVENTION

An object, therefore, of the present invention is to provide an intermetallic compound alloy that has improved thoughness and which yet exhibits better machineability than the conventional product. This object can be achieved by an intermetallic compound alloy that contains 45–60% of Ni, Co or both with a cobalt content of at least 5%, at least one of 0.1–2% of Hf and 0.05–2% of Re, 0–2% of at least one element selected from the group consisting of Si, P, Cu, Zn, Ga, Ge, Cd, In, Sn, Sb, Pb and Bi, 0–2% of C, and 0–5% of at least one element selected from the group consisting of Zr, Fe, V, Nb, Ta, Cr, Mo, W and Mn, with the balance being Ti and incidental impurities.

DETAILED DESCRIPTION OF THE INVENTION

The present inventors conducted various studies in order to improve the machineability of the conventional intermetallic compound alloy described above. As a result, the inventors have obtained the following observations: If Hf is incorporated as an alloying component, the machine-ability of the alloy is appreciably improved without impairing its inherent superior wear resistance; if Re is incorporated, not only the machineability of the alloy but also its toughness is increased since Re binds with oxygen dissolved in the alloy matrix so as to cause a substantial drop in the oxygen content of the alloy; if, in addition to Hf or Re, at least one element selected from the group consisting of Si, P, Cu, Zn, Ga, Ge, Cd, In, Sn, Sb, Pb and Bi (these elements are hereinafter referred to as machine-ability improving components), is incorporated, the machine-ability of the alloy is further improved without impairing its inherently high wear resistance; finally, a further improvement in the wear resistance of the alloy is attained by incorporating C or at least one elemenet selected from the group consisting of Zr, Fe, V, Nb, Ta, Cr, Mo, W and Mn (these elements other than carbon are hereinafter referred to as wear resistance improving components).

The present invention has been accomplished on the basis of these findings.

The criticality of the compositional range of each of the components shown above is hereunder described.

(a) Ni and Co

These elements combine with Ti to form intermetallic compounds that serve to improve the wear resistance of the resulting alloy significantly. If the content of Ni or Co is less than 45%, the relative content of Ti becomes excessive and the desired wear resistance is not attainable. If, on the other hand, the content of Ni or Co exceeds 60%, the relative content of Ti becomes so small that the resulting alloy is brittle and fails to exhibit the desired wear resistance. Therefore, the content of each of Ni and Co is limited to lie within the range of 45–60%, preferably between 47 and 53%.

(b) Hf and Re

These elements have the ability to improve the machineability of the alloy without impairing its inherently high wear resistance. They may be used either independently or in combination. If the content of Hf is less than 0.1%, the desired machineability is not obtainable. If the Hf content exceeds 2%, the alloy has a tendency to become brittle. Therefore, the content of Hf is specified to lie within the range of 0.1–2%. Other than the ability to improve the machineability of the alloy, Re serves as an oxygen scavenger that binds with oxygen dissolved in the alloy matrix, to thereby improve the toughness of the alloy. If the content of Re is less than 0.05%, the intended effects of Re are not obtained. If the Re content exceeds 2%, the alloy will become brittle rather than acquire improved toughness. Therefore, the content of Re is specified to lie within the range of 0.05–2%.

(c) machineability improving component (Si, P, Cu, Zn, Ga, Ge, Cd, In, Sn, Sb, Pb and Bi)

These elements, when incorporated in combination with Hf, have the ability to provide significantly improved machineability without impairing the inherently high wear resistance of the alloy. If the content of each of these elements is less than 0.1%, the desired machineability is not attainable. If their content exceeds 2%, the alloy will become brittle. Therefore, the content of the machineability improving component is preferably within the range of 0.1–2%.

(d) C

Carbon, if it is incorporated in combination with Hf, is effective in achieving a further improvement in the wear resistance of the alloy without rendering it brittle. If the carbon content is less than 0.05%, the desired effect of carbon to provide higher wear resistance is not attained. If the carbon content exceeds 2%, the alloy will become brittle. Therefore, the content of carbon, if used at all, is preferably within the range of 0.05–2%.

(e) Wear resistance improving component (Zr, Fe, V, Nb, Ta, Cr, Mo, W and Mn)

If the content of any of these elements is less than 0.1%, the desired improvement in wear resistance is not attained. If the content of these elements exceeds 5%, the alloy will become brittle and its machineability is reduced, rather than improved. Therefore, the content of the wear resistance improving element is preferably within the range of 0.1–5% and more preferably within the range of 0.1–3%.

The alloy of the present invention is hereunder described in greater detail with reference to working examples, to which, however, the scope of the invention is by no means limited.

EXAMPLE 1

Alloy samples having the compositions shown in the tables were melted in a plasma arc furnace. After being cast into ingots, the samples were re-melted in an arc furnace, precision-cast in ceramic molds by the centrifugal casting method, and subsequently surface-polished to form shapings which measured 20 mm in diameter and 5 mm thick.

The so prepared sample Nos. 1 to 50 of the present invention and conventional sample Nos. 1 to 13 were subjected to tests for the evaluation of their wear resistance by measurement of their Vickers hardnesses. With a view to evaluating the machineability of each alloy sample, a drilling test was conducted for each with a drill that was made of a WC-based sintered hard metal and which had a tip diameter of 7 mm. The drill was revolved at 159 rpm. The test results were evaluated in terms of the time required to drill a hole through each sample and the development of any nick at the hole edge. The results of the measurement of Vickers hardness and of the drilling test are summarized in the tables.

As the tables show, sample Nos. 1–50 of the present invention were as hard (i.e., wear-resistant) as conventional sample Nos. 1–13 and yet exhibited much better machineability.

TABLE 1

| | Composition (at. %) | | | | | | | |
|---|---|---|---|---|---|---|---|---|
| Sample No. | Ni | Co | Hf | wear resistance improving component | Ti + impurities | Vickers hardness (Hv) | Drill time (min) | Edge Nick |
| | | | | Alloy of the present invention | | | | |
| 1 | — | 46.1 | 0.9 | — | bal. | 312 | 4.6 | negative |
| 2 | — | 51.0 | 1.2 | — | bal. | 355 | 4.8 | " |
| 3 | — | 58.6 | 1.1 | — | bal. | 409 | 5.2 | " |
| 4 | 26.4 | 24.5 | 1.0 | — | bal. | 365 | 3.0 | " |
| 5 | 26.1 | 24.5 | 0.7 | Zr:0.2 | bal. | 370 | 3.3 | " |
| 6 | 24.7 | 24.2 | 0.5 | Fe:1.6 | bal. | 374 | 3.9 | " |
| 7 | 44.2 | 5.5 | 0.8 | Nb:0.5 | bal. | 382 | 3.5 | " |
| 8 | 25.0 | 24.5 | 0.6 | Ta:0.9 | bal. | 349 | 4.6 | " |
| 9 | — | 48.0 | 0.9 | Cr:2.1 | bal. | 375 | 5.1 | " |
| 10 | 25.3 | 24.2 | 0.5 | Mo:1.1 | bal. | 394 | 3.2 | " |
| 11 | 25.0 | 21.2 | 0.2 | W:4.6 | bal. | 413 | 4.5 | " |
| 12 | 25.8 | 23.2 | 1.2 | Zr:0.2, Ta:0.6 | bal. | 388 | 4.3 | " |
| 13 | 21.8 | 25.7 | 0.6 | V:0.5, Cr:2.4 | bal. | 405 | 4.4 | " |
| 14 | — | 48.6 | 0.7 | Fe:0.3, Nb:0.4, Mo:1.0 | bal. | 396 | 4.6 | " |
| 15 | 23.1 | 23.3 | 1.6 | Zr:02, Fe:0.2, Cr:1.1, W:1.5 | bal. | 420 | 4.7 | " |
| | | | | Conventional alloy | | | | |
| 1 | — | 47.0 | — | — | bal. | 311 | 6.6 | Positive |
| 2 | — | 52.1 | — | — | bal. | 363 | cracked | — |
| 3 | — | 59.1 | — | — | bal. | 399 | 7.1 | Positive |
| 4 | 25.6 | 24.7 | — | Mo:1.4, Fe:0.2 | bal. | 477 | cracked | Positive |
| 5 | 49.1 | 7.2 | — | — | bal. | 477 | cracked | Positive |

TABLE 2

| | Composition (at. %) | | | | | | | | |
|---|---|---|---|---|---|---|---|---|---|
| Sample No. | Ni | Co | Hf | machineability improving component | wear resistance improving component | Ti + impurities | Vickers hardness (Hv) | Drill time (min) | Edge Nick |
| | | | | Alloy of the present invention | | | | | |
| 16 | — | 45.9 | 0.87 | Cd:1.05 | — | bal. | 242 | 4.1 | negative |
| 17 | — | 52.0 | 0.12 | Si:0.12, Zn:0.11 Ga:0.11 | — | bal. | 270 | 4.3 | " |
| 18 | — | 59.6 | 1.16 | Sn:1.89 | — | bal. | 234 | 3.8 | " |
| 19 | 24.3 | 26.4 | 1.09 | P:0.14 | — | bal. | 237 | 3.6 | " |
| 20 | 24.8 | 25.8 | 0.12 | Bi:0.16 | — | bal. | 246 | 4.2 | " |
| 21 | 24.6 | 26.1 | 1.96 | Cu:0.30, Zn:0.05, Cd:0.08, In:0.04, Pb:0.06 | — | bal. | 244 | 3.9 | " |
| 22 | — | 49.8 | 1.00 | In:0.18 | Zr:1.2 | bal. | 296 | 4.0 | " |
| 23 | 22.8 | 26.0 | 1.06 | Cu:0.33, PB:0.10 | Cr:2.8 | bal. | 342 | 4.1 | " |
| 24 | 24.3 | 22.9 | 1.04 | Si:0.16, Cu:0.29, | Nb:3.5 | bal. | 361 | 4.0 | " |

TABLE 2-continued

| Sample No. | Ni | Co | Hf | machineability improving component | wear resistance improving component | Ti + impurities | Vickers hardness (Hv) | Drill time (min) | Edge Nick |
|---|---|---|---|---|---|---|---|---|---|
| | | | | Composition (at. %) | | | | | |
| 25 | 24.3 | 21.6 | 1.11 | Zn:0.11 Cu:0.31, Sb:0.12 | V:0.2, Ta:0.3, Mo:1.2, Fe:2.9 | bal. | 393 | 4.1 | " |
| 26 | 20.8 | 24.3 | 1.10 | Zn:0.16, Ge:0.13 | W:4.9 | bal. | 408 | 4.2 | " |
| | | | | | Conventional alloy | | | | |
| 1 | — | 47.0 | — | — | — | bal. | 311 | 6.0 | positive |
| 2 | — | 52.1 | — | — | — | bal. | 363 | cracked | — |
| 3 | — | 59.1 | — | — | — | bal. | 462 | " | — |
| 4 | 25.6 | 24.7 | — | — | Mo:1.4, Fe:0.2 | bal. | 399 | 6.5 | positive |
| 5 | 49.1 | 7.2 | — | — | — | bal. | 477 | cracked | — |

TABLE 3

| Sample No. | Ni | Co | Hf | C | Wear resistance improving component | Ti + impurities | Vickers Hardness (Hv) | Drill time (min) | Edge Nick |
|---|---|---|---|---|---|---|---|---|---|
| | | | | | Composition (at. %) | | | | |
| | | | | | Alloy of the present invention | | | | |
| 27 | — | 47.1 | 1.1 | 0.9 | — | bal. | 340 | 6.3 | negative |
| 28 | — | 51.3 | 0.9 | 1.0 | — | bal. | 351 | 6.7 | " |
| 29 | — | 58.4 | 1.0 | 1.1 | — | bal. | 432 | 6.8 | " |
| 30 | 24.6 | 25.4 | 1.1 | 0.9 | — | bal. | 385 | 4.5 | " |
| 31 | — | 50.8 | 0.11 | 1.0 | — | bal. | 392 | 4.6 | " |
| 32 | 24.6 | 25.3 | 1.1 | 1.9 | — | bal. | 439 | 5.1 | " |
| 33 | — | 50.8 | 1.0 | 1.1 | V:1.0 | bal. | 368 | 6.9 | " |
| 34 | 23.8 | 26.4 | 1.1 | 0.9 | Nb:3.2 | bal. | 450 | 5.7 | " |
| 35 | — | 52.6 | 1.1 | 0.8 | Cr:2.1 | bal. | 370 | 7.0 | " |
| 36 | 20.3 | 30.4 | 0.9 | 1.0 | Mo:0.3 | bal. | 401 | 6.5 | " |
| 37 | — | 50.9 | 0.9 | 0.9 | Zr:2.4, Fe:1.0 | bal. | 430 | 7.2 | " |
| 38 | 29.4 | 20.4 | 1.1 | 1.0 | V:2.0, Nb:1.1, W:0.8 | bal. | 446 | 6.9 | " |
| | | | | | Conventional alloy | | | | |
| 6 | — | 46.1 | — | — | — | bal. | 310 | 9.9 | positive |
| 7 | — | 50.1 | — | — | — | bal. | 357 | cracked | — |
| 8 | — | 58.7 | — | — | — | bal. | 440 | " | — |
| 9 | 25.1 | 25.3 | — | — | Mo:1.4, Fe:0.2 | bal. | 383 | 11.3 | positive |
| 10 | 23.1 | 26.4 | — | — | — | bal. | 353 | 10.1 | " |

TABLE 4

| Sample No. | Ni | Co | Re | Hf | wear resistance improving Component | Ti + impurities | Cracking | Drill time (min) | Vickers hardness (Hv) | Edge nick |
|---|---|---|---|---|---|---|---|---|---|---|
| | | | | | Composition (at. %) | | | | | |
| | | | | | Alloy of the present invention | | | | | |
| 39 | — | 47.1 | 0.9 | — | — | bal. | negative | 3.9 | 322 | negative |
| 40 | — | 50.2 | 1.1 | — | — | bal. | " | 4.2 | 368 | " |
| 41 | — | 52.8 | 0.9 | — | — | bal. | " | 4.6 | 380 | " |
| 42 | 24.6 | 24.9 | 1.0 | — | — | bal. | " | 3.3 | 375 | " |
| 43 | 23.1 | 26.7 | 0.052 | — | — | bal. | " | 3.9 | 388 | " |
| 44 | — | 49.6 | 1.0 | 0.12 | — | bal. | " | 2.8 | 377 | " |
| 45 | 24.3 | 24.9 | 1.0 | — | Fe:1.5 | bal. | " | 4.1 | 392 | " |
| 46 | — | 50.4 | 1.0 | — | Ta:2.9 | bal. | " | 4.3 | 381 | " |
| 47 | — | 51.0 | 1.0 | — | Mn:2.8 | bal. | " | 4.6 | 381 | " |
| 48 | 24.8 | 24.6 | 1.1 | — | V:0.3, Mo:0.4, W:0.4, Mn:0.2 | bal. | " | 3.7 | 389 | " |
| 49 | — | 50.4 | 0.3 | 0.18 | W:0.15 | bal. | " | 3.0 | 368 | " |
| 50 | 24.1 | 25.2 | 1.1 | 0.91 | Fe:0.1, Ta:0.3, Mo:0.4, Mn:0.2 | bal. | " | 2.8 | 367 | " |
| | | | | | Conventional alloy | | | | | |
| 11 | — | 50.8 | — | — | — | bal. | positive | cracked | 358 | — |
| 12 | 25.1 | 25.2 | — | — | — | bal. | " | 6.9 | 360 | positive |
| 13 | 24.6 | 24.3 | — | — | Mo:1.5, Fe:0.2 | bal. | " | cracked | 390 | — |

In summary, the alloy of the present invention is superior not only in machineability but also in wear resistance. In a preferable embodiment, the alloy has the additional advantage of exhibiting superior toughness. Therefore, the alloy can be readily machined into various wear-resistant parts without experiencing any crack formation. In addition, the so fabricated parts will exhibit their superior properties over an extended period of time.

What is claimed is:

1. A wear-resistant intermetallic compound alloy having superior machineability which consists essentially of: (i) 45–60% of Co or (ii) a Co and Ni content of 45–60% with the Co content being at least 5%; at least one of 0.1–2% of Hf and 0.05–2% of Re; 0.1–2% of at least one element selected from the group consisting of Si, P, Cu, Zn, Ga, Ge, Cd, In, Sn, Sb, Pb, and Bi; 0–2% of C; and 0–5% of at least one element selected from the group consisting of Zr, Fe, V, Nb, Ta, Cr, Mo, W and Mn; the balance being Ti and incidental impurities, the percent being atomic percent.

2. A wear-resistant intermetallic compound alloy having superior machineability which consists essentially of: (i) 45–60% of Co or (ii) a Co and Ni content of 45–60% with the Co content being at least 5%; at least one of 0.1–2% of Hf and 0.05–2% of Re; 0–2% of at least one element selected from the group consisting of Si, P, Cu, Zn, Ga, Ge, Cd, In, Sn, Sb, Pb, and Bi; 0.05–2% of C; and 0–5% of at least one element selected from the group consisting of Zr, Fe, V, Nb, Ta, Cr, Mo, W and Mn; the balance being Ti and incidental impurities, the percent being atomic percent.

3. A wear-resistant intermetallic compound alloy having superior machineability which consists essentially of: (i) 47–53% of Co or (ii) a Co and Ni content of 47–53% with the Co content being at least 5%; at least one or 0.1–2% of Hf and 0.05–2% of Re; 0.1–2% of at least one element selected from the group consisting of Si, P, Cu, Zn, Ga, Ge, Cd, In, Sn, Sb, Pb, and Bi; 0–2% of C; and 0–5% of at least one element selected from the group consisting of Zr, Fe, V, Nb, Ta, Cr, Mo, W and Mn; the balance being Ti and incidental impurities, the percent being atomic percent.

4. The alloy according to claim 3, which contains 0.05–2% of C.

5. The alloy according to claim 4 which contains 0.1–5% of at least one element selected from the group consisting of Zr, Fe, V, Nb, Ta, Cr, Mo, W and Mn.

6. The alloy according to claim 4 which contains 0.1–3% of at least one element selected from the group consisting of Zr, Fe, V, Nb, Ta, Cr, Mo, W and Mn.

7. The alloy according to claim 6 which contains a total of 47–53% nickel and cobalt with the cobalt content being at least 20%.

8. The alloy according to claim 6 which contains 47–53% cobalt and does not contain nickel.

9. A wear-resistant intermetallic compound alloy having superior machineability which consists essentially of: (i) 47–53% of Co or (ii) a Co and Ni content of 47–53% with the Co content being at least 5%, at least one of 0.1–2% of Hf and 0.05–2% of Re; 0.2% of at least one element selected from the group consisting of Si, P, Cu, Zn, Ga, Ge, Cd, In, Sn, Sb, Pb, and Bi; 0.05–2% of C; and 0.1–3% of at least one element selected from the group consisting of Zr, Fe, V, Nb, Ta, Cr, Mo, W and Mn; the balance being Ti and incidental impurities, the percent being atomic percent.

10. The alloy according to claim 9 which contains 0.1–2% of at least one element selected from the group consisting of Si, P, Cu, Zn, Ga, Ge, Cd, In, Sn, Sb, Pb and Bi.

11. A wear-resistant intermetallic compound alloy having superior machineability which consists essentially of: a Co and Ni content of 47–60% with the Co content being at least 20%; at least one if 0.1–2% of Hf and 0.05–2% of Re; 0–2% of at least one element selected from the group consisting of Si, P, Cu, Zn, Ga, Ge, Cd, In, Sn, Sb, Pb, and Bi; 0–2% of C; and 0–5% of at least one element selected from the group consisting of Zr, Fe, V, Nb, Ta, Cr, Mo, W and Mn; the balance being Ti and incidental impurities, the percent being atomic percent.

12. The alloy according to claim 11 which contains a total of 47–53% nickel and cobalt with the cobalt content being at least 20%.

13. A wear-resistant intermetallic compound alloy having superior machineability which consists essentially of: 45–60% of Co and does not contain Ni; at least one of 0.1–2% of Hf and 0.05–2% of Re; 0–2% of at least one element selected from the group consisting of Si, P, Cu, Zn, Ga, Ge, Cd, In, Sn, Sb, Pb, and Bi; 0–2% of C; and 0–5% of at least one element selected from the group consisting of Zr, Fe, V, Nb, Ta, Cr, Mo, W and Mn; the balance being Ti and incidental impurities, the percent being atomic percent.

14. The alloy according to claim 13, which contains a total of 47–53% cobalt and does not contain nickel.

* * * * *

UNITED STATES PATENT AND TRADEMARK OFFICE

CERTIFICATE OF CORRECTION

PATENT NO. : 4,874,577

DATED : October 17, 1989

INVENTOR(S) : WAKITA et al

It is certified that error appears in the above-identified patent and that said Letters Patent is hereby corrected as shown below:

Title page, Abstract, line 3:

After "both with", insert -- a --.

Signed and Sealed this

Twenty-fifth Day of August, 1992

*Attest:*

DOUGLAS B. COMER

*Attesting Officer*

*Acting Commissioner of Patents and Trademarks*